US006041446A

United States Patent [19]

Braunstein et al.

[11] Patent Number: 6,041,446

[45] Date of Patent: Mar. 28, 2000

[54] PANTY WITH INTEGRATED TREATED CROTCH

[75] Inventors: Robert A. Braunstein, Lumberton, N.C.; Craig Gendel, Weston, Conn.

[73] Assignee: Ultimair Corporation, Lumberton, N.C.

[21] Appl. No.: 09/360,810

[22] Filed: Jul. 26, 1999

[51] Int. Cl.[7] ..... A41B 9/00

[52] U.S. Cl. ..... 2/400; 2/406; 2/403; 66/176; 66/202; 604/396

[58] Field of Search ..... 2/400–408, 267, 2/53–58; 66/169 R, 175, 176, 177, 202; 604/360, 396, 385.1; 450/102–105, 156

[56] References Cited

U.S. PATENT DOCUMENTS

| | | | |
|---|---|---|---|
| 2,898,754 | 8/1959 | Harms | 2/400 |
| 4,155,123 | 5/1979 | Popper | 2/239 |
| 4,244,059 | 1/1981 | Pflaumer | 2/400 |
| 4,343,853 | 8/1982 | Morrison | 428/233 |
| 4,731,063 | 3/1988 | Newkirk | 604/385.1 |
| 4,810,567 | 3/1989 | Calcaterra et al. | 428/224 |
| 5,098,419 | 3/1992 | Gold | 604/396 |
| 5,152,014 | 10/1992 | Marx et al. | 2/406 |
| 5,416,929 | 5/1995 | Braunstein | 2/406 |

*Primary Examiner*—Gloria Hale
*Attorney, Agent, or Firm*—Coats & Bennett, P.L.L.C.

[57] ABSTRACT

A panty having a front panel, a back panel, and a crotch section positioned between the front and back panels. The front and back panels are constructed from at least a first yarn type, as the crotch section is constructed from the first yarn type and an integrated second yarn type that is pretreated with a chlorinated phenoxy antimicrobial composition to kill and inhibit the growth of bacteria and yeast. The panty is formed in an operation that seamlessly integrates the front panel, crotch section, and back panel.

27 Claims, 4 Drawing Sheets

PANTY WITH INTEGRATED TREATED CROTCH

BACKGROUND OF THE INVENTION

1. Field of the Invention

The present invention is directed to a panty and, more particularly, to a panty having a seamless construction and a crotch formed with a pretreated antimicrobial yarn for killing and inhibiting the growth of yeast and bacteria.

2. Description of the Prior Art

It has been known to provide panties with a crotch that has been treated to control various concerns. For example, U.S. Pat. No 4,244,059, discloses a panty crotch that comprises a fabric makeup that is designed to absorb odorous molecules from the crotch region. In particular, the crotch panel of this disclosure features a soft fabric that has a substantial air permeability with an alkali metal carbonate compound that causes the panty crotch to essentially absorb certain odors in and around the crotch region.

U.S. Pat No. 4,731,063 discloses a disposable insert device that can be placed within an undergarment in the crotch region that is effective to inhibit bacterial growth and which is claimed to suppress and reduce undesirable body odors in the crotch and genital area.

U.S. Pat. No. 5,152,014 discloses a liner for a woman's body undergarment that is formed of a hydrophobic fiber having an irregular outer surface which "wicks" moisture away from the body. This patent appreciates that by reducing the moisture content in the crotch region of a woman's panty that such may help reduce the generation of yeast infections.

It is further appreciated that yeast infections among women are both common and certainly aggravating and discomforting. Presently, there is little that a woman can actually do to prevent yeast infections before they occur. Usually, yeast infections are treated only after they are present and the unpleasant accompanying symptoms have become manifested.

There is and continues to be a need to treat or more particularly to kill and inhibit the growth of yeast and bacteria before the microorganisms have an opportunity to give rise to an infection.

SUMMARY OF THE INVENTION

The present invention is directed to a panty having a front panel, a back panel, and a crotch section positioned between the front and back panels. The front and back panels are constructed from at least a first yarn type, as the crotch section is constructed from the first yarn type and an integrated second yarn type that is pretreated with a chlorinated phenoxy antimicrobial composition to kill and inhibit the growth of bacteria and yeast. The panty is formed in an operation that seamlessly integrates the front panel, crotch section, and back panel providing for easier manufacturing and a more comfortable fit.

A method of manufacturing the panty includes knitting the front panel with a first knit construction and using a first yarn type. The crotch section is seamlessly positioned adjacent to the front panel and includes at least both the first yarn type and a second antimicrobial yarn. Preferably, the crotch section has a different knit construction than the front panel. The back panel is seamlessly added to the crotch section by removing the antimicrobial yarn and changing the knit construction to that of the front panel. The sides of the front and back panels are connected together forming the panty A second method of making the panty includes knitting the various sections of the panty seamless together to form a tube-like garment. Leg openings are cut from one end of the tube and the opening is seamed together forming the panty.

DETAILED DESCRIPTION OF THE PREFERRED EMBODIMENTS

Figure 1:
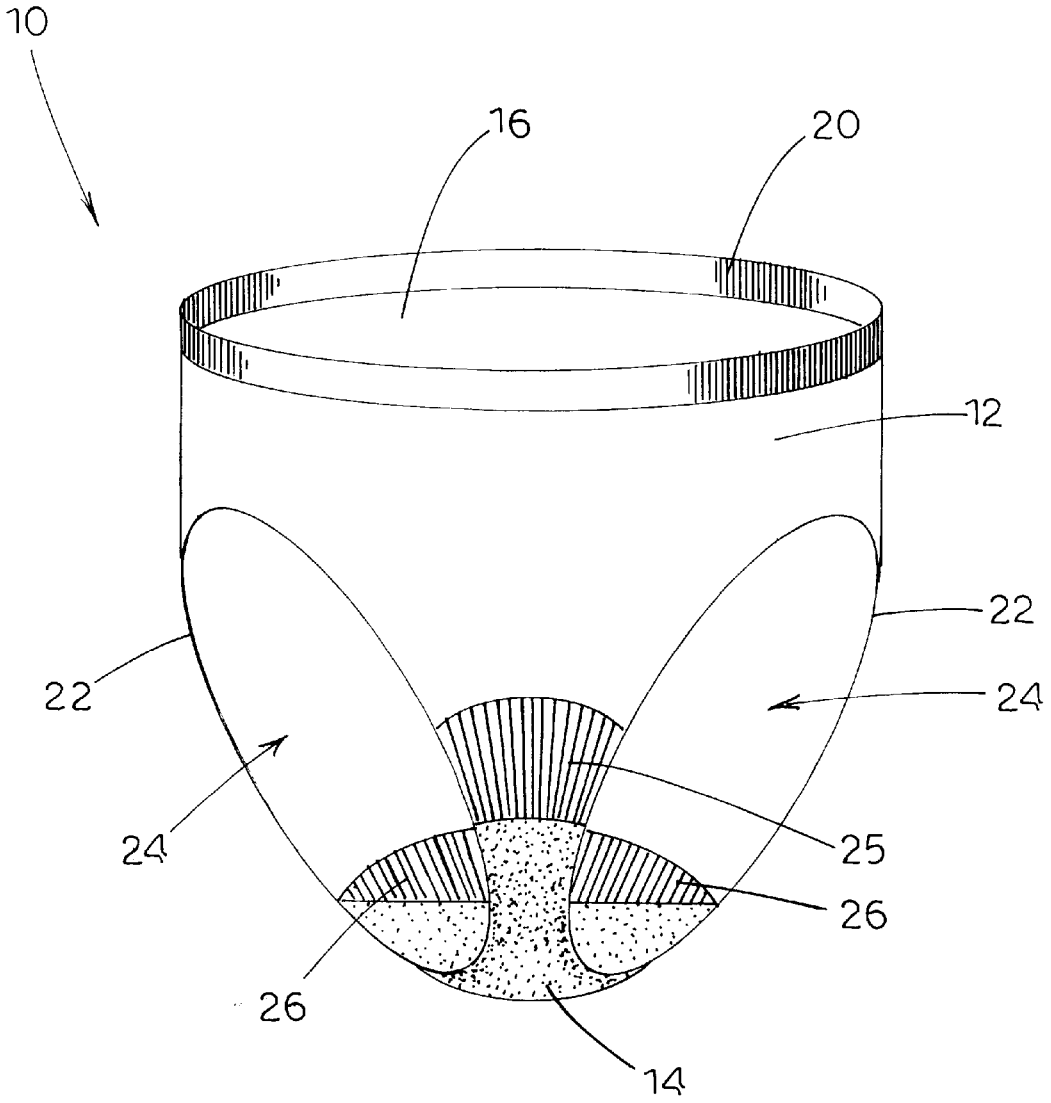
FIG. 1 is a perspective view of panty constructed according to the present invention.

The present invention is directed to a panty, generally indicated by numeral 10 in FIG. 1, having a front panel 12 and back panel 16. A crotch section 14 is positioned between the panels and includes yarns that have been pretreated with an antimicrobial composition to kill and inhibit the growth of bacteria and yeast that give rise to infections within women. Transitional areas 25, 26 may be positioned between the panels and crotch section for improving the comfort and feel of the panty to a user.

The front panel 12 and back panel 16 are constructed of a first yarn type and preferably formed of a knit construction. In one embodiment, the panels are formed of at least two nylon yarns. Other types of yarns including cotton yarns and a stretch yarn, such as LYCRA®, may be used for constructing the panels and additional yarns may be inserted depending upon the desired appearance, feel, texture, and knit construction. Additionally, the front panel may have a different knit construction than the back panel, and may be constructed of different yarn types.

The crotch section 14 is positioned between front panel 12 and back panel 16. Crotch section 14 includes the first yarn type used in the front and back panels and at least a second yarn type that is pretreated with an antimicrobial composition. The crotch section 14 may be formed of any number of individual yarns from the first and second yarn types. In addition, other yarn types may be inserted for aesthetic and/or comfort purposes. In one embodiment, the crotch section 14 is constructed of at least two nylon yarns and one acetate yarn that has been pretreated with an antimicrobial composition.

In a preferred embodiment, the antimicrobial composition is a chlorinated phenoxy antimicrobial composition and the pretreated yarn is an acetate yarn subjected to the antimicrobial composition prior to being fabricated into the crotch section 14. For acetate treated yarn, the chlorinated phenoxy antimicrobial composition is acetone soluble and is introduced into cellulose acetate dope from an acetone solution.

The crotch section 14 is preferably of a different knit construction than the front and back panels such as a loop structure of a mock terry knit for providing more contact surfaces between the user and the crotch section. The construction of the crotch section is also effective to control the moisture by either transporting away or absorbing the moisture to further prevent bacteria and infections.

A front transitional area 25 and back transitional area 26 may be positional between the panels and crotch section 14 as illustrated in FIG. 1. The transitional areas taper down between the user's legs to further increase comfort and fit of the panty. Preferably, the transitional areas are constructed of the same yarns used within the front panel 12 and back panel 16. However, a different knit construction may be used for the transitional areas than in the panels 12, 16 or crotch section 14.

A band 20 may extend around the upper edge of the front and back panels for holding the panty on the user. Several different embodiments of the band 20 are contemplated in the present invention and may include a band constructed of a different yarn type, such as elastic knit within the panels, or the same knit construction as the panels and folded for a two-ply construction. Additionally, a border 22 may be placed around leg openings 24 to provide for a more comfortable fit.

Figure 4:
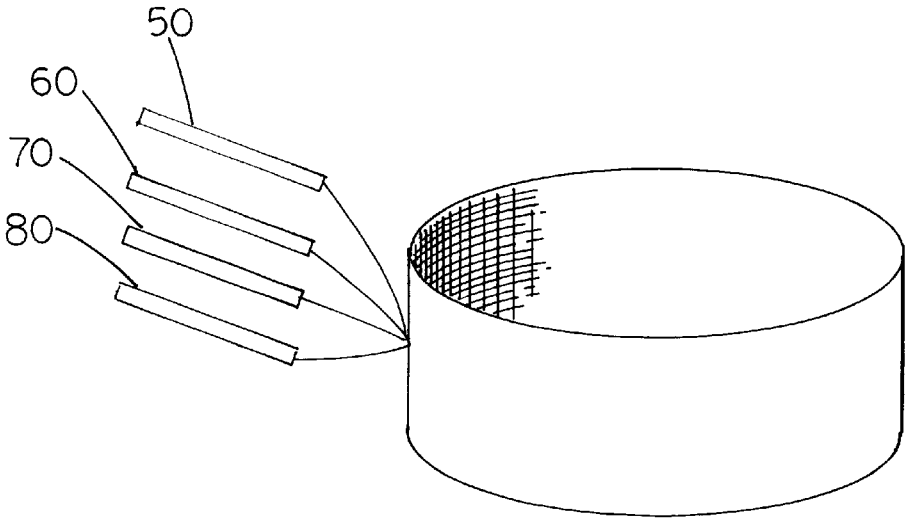
FIG. 4 is a schematic view of the feeds and yarns being inserted into the garment during the manufacturing process.

The panty may be constructed in a variety of methods. One method illustrated in FIGS. 2A–2C uses a circular knitting or hosiery machine commonly known in the art. These types of machines provide for a variety of feeds to feed yarn into the knitting elements and may be programmed to feed yarns into the knitting elements at different stages while producing the garment. In one embodiment, there are four feeds that lead into the machine. FIG. 4 illustrates a schematic representation of four feeds 50, 60, 70, 80, feeding yarn into the garment 10. In one embodiment, nylon yarn is introduced through feeds 50 and 60, an acetone yarn pretreated with the antimicrobial composition is introduced through feed 70, and polyester yarn is introduced through feed 80. As illustrated in FIG. 2A, the panty is constructed by feeding the nylon yarns of feeds 50 and 60 to initially knit the back panel 16. At the completion of the back panel 16, the machine is programmed to continue feeding nylon yarns 50 and 60 and seamlessly changing the knit construction to form transitional area 26. At the completion of the transitional area 26, the machine is programmed to seamlessly change the knit construction and also introduce the antimicrobial yarn through feed 70 and the polyester yarn through feed 80 to form the crotch section 14. This order is then reversed to form the remainder of the garment by seamlessly removing feeds 80 and 70 and changing the knit construction to form transitional area 24, and seamlessly changing the knit construction to form front panel 12. The garment is removed from the machine at completion of formation resulting in a tube structure as illustrated in FIG. 2A. In an alternative embodiment, a stretch yarn may be inserted in place of the polyester yarn.

Figure 2B:
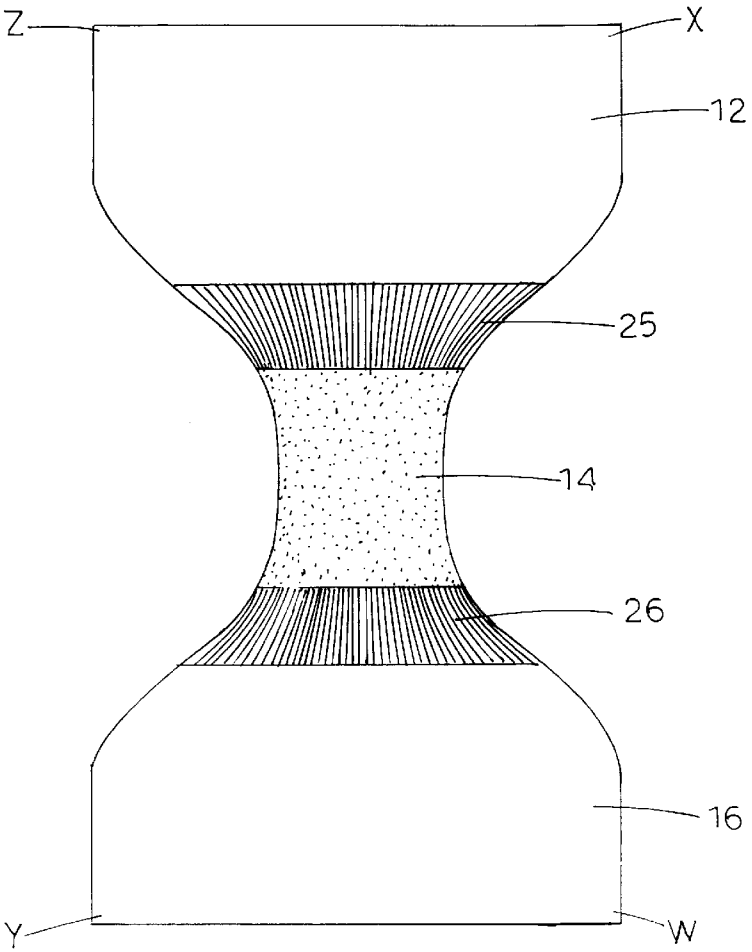
FIG. 2B illustrates the panty of FIG. 2A after being slit lengthwise.
Figure 2A:
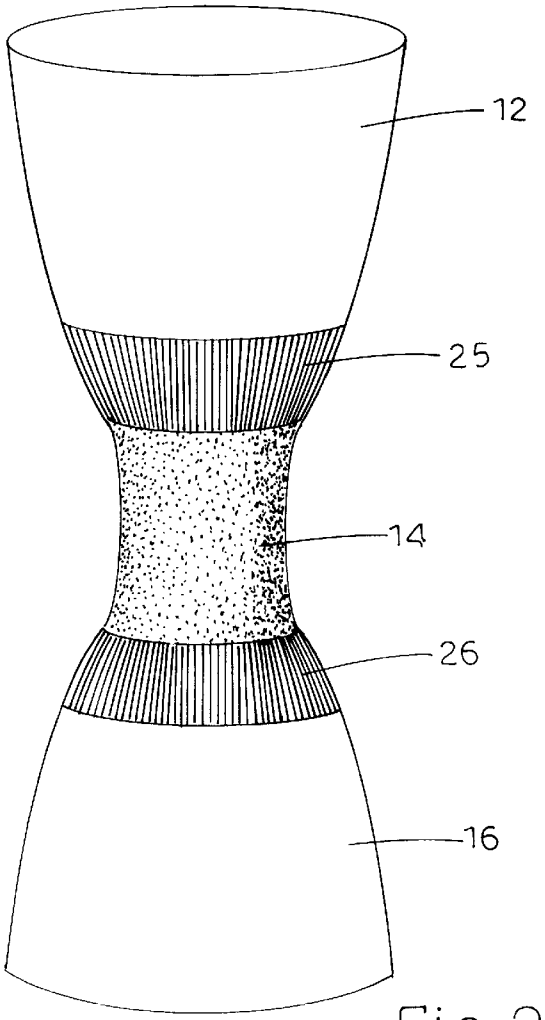
FIG. 2A is a perspective view of a panty knitted by a circular knitting machine or hosiery machine.
Figure 2C:
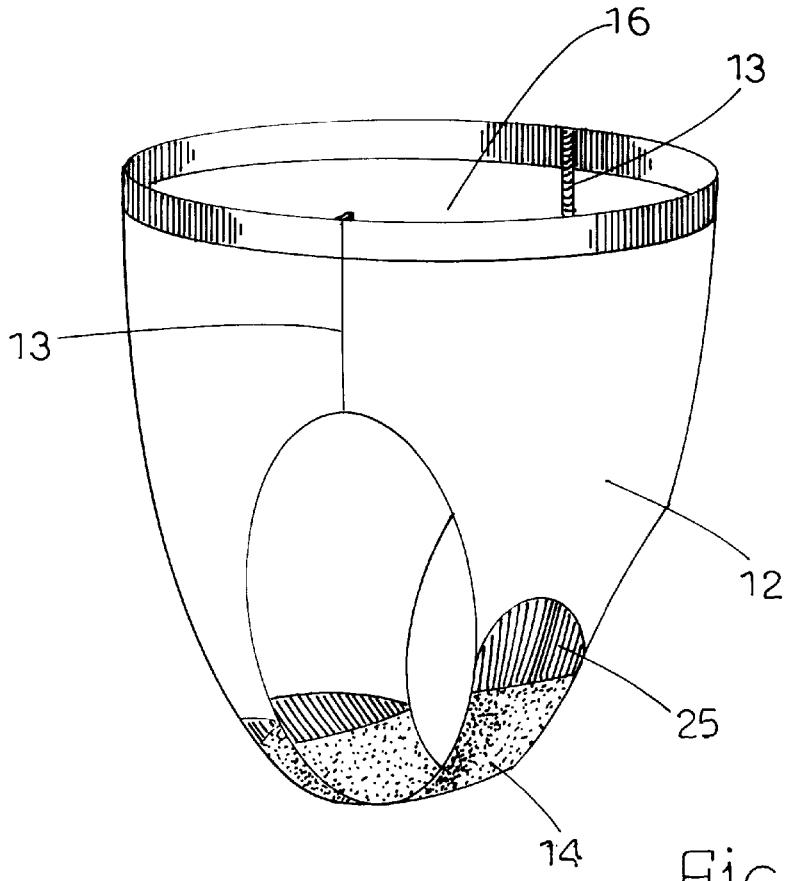
FIG. 2C is a perspective view illustrating the completed panty constructed according to one embodiment of the present invention.

The tube is slit lengthwise and laid open as illustrated in FIG. 2B. Edges of the front panel represented by Z and X are then sewn together with edges of the back panel 16 illustrated by Y and W along seams 13 to form the panty as illustrated in FIG. 2C. This embodiment provides the length of the panty to be seamless for a more comfortable fit by placing seams 13 along the sides of the panty positioned along the sides of the users legs.

Figure 3A:
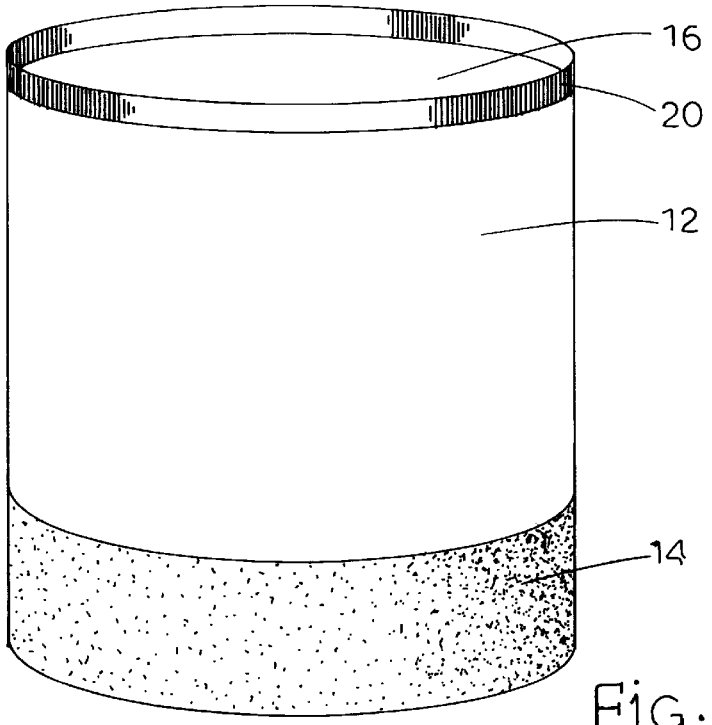
FIG. 3A illustrates a panty knitted in a tube within a seamless panty machine.
Figure 3B:
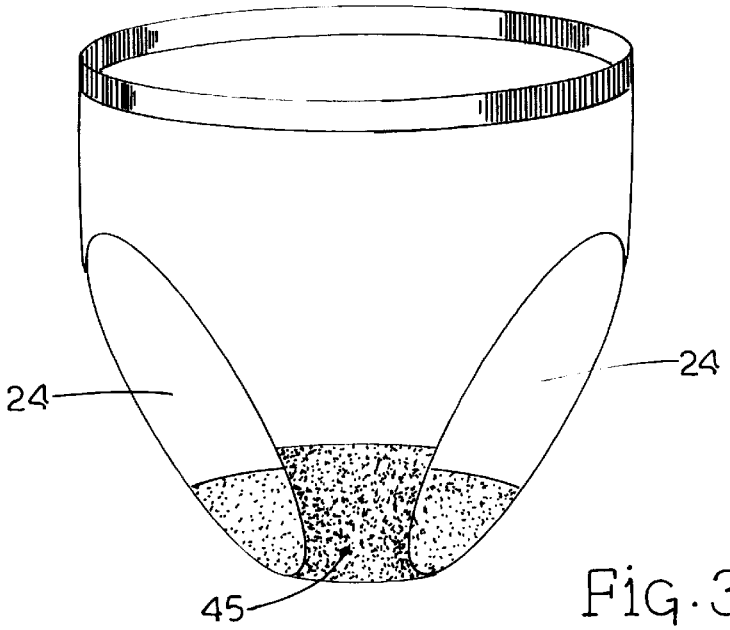
FIG. 3B is a perspective view of the completed panty of FIG. 3A constructed according to the present invention.

FIGS. 3A and 3B illustrate a second method of producing the panty of the present invention through the use of a seamless panty machine. The seamless panty machine produces a tube garment as illustrated in FIG. 3A by introducing yarns and changing knit construction as previously described. The knitted garment once removed from the seamless panty machine is illustrated in FIG. 3A. Leg openings 24 are cut within the panty and sewn together in the crotch section 14 by seam 45 to produce a finished panty as illustrated in FIG. 3B. Alternatively, seam 45 may be positioned between the crotch section 14 and the front panel 12 or crotch section 14 and back panel 16.

In the following description, like referenced characters designate like or corresponding parts throughout the several views. Also in the foregoing description, it is to be understood that such terms as "forward", "rearward", "left", "right", "upwardly", "downwardly", and the like are words of convenience and are not to be construed as limiting terms. Certain modifications and improvements will occur to those skilled in the art upon the reading of the foregoing description. It should be understood that all such modifications and improvements have been deleted herein for the sake of conciseness and readability but are property within the scope of the following claims.

What is claimed is:

1. A panty comprising a front panel, a back panel, and a crotch section positioned between said front and back panels, the panty being constructed of a plurality of yarns with one or more of said yarns extending through said front and back panels and said crotch section, and a pretreated antimicrobial yarn extending through said crotch section and integrated with one or more of said yarns that extend through the front and back panels as well as the crotch section.

2. The panty of claim 1, wherein said front and back panels are formed of a first knit construction and said crotch section is formed of a second knit construction different than said first knit construction.

3. The panty of claim 2, wherein said second knit construction of said crotch section is a mock terry knit.

4. The panty of claim 1, wherein said front and back panels include at least two separate yarns both containing nylon and knitted continuously and throughout said front and back panels.

5. The panty of claim 1, wherein said front and back panels include at least two separate yarns both containing cotton which are knitted continuously and throughout said front and back panels.

6. The panty of claim 1, wherein said crotch section includes at least three separate yarns, at least two nylon yarns and an acetate yarn, knitted continuously throughout.

7. The panty of claim 1, further including a band positioned along an upper edge of said front and back panels opposite said crotch section.

8. The panty of claim 7, wherein said band has the same knit construction as said front and back panels.

9. The panty of claim 1, wherein said front panel, back panel, and crotch section are knitted together in an hourglass shape, and wherein the width of the front and back panels taper inwardly toward the crotch section.

10. The panty of claim 9, wherein two seams connect said front and back section side edges forming leg openings.

11. The panty of claim 1, wherein said antimicrobial yarns functions to kill or inhibit the growth of yeast and bacteria.

12. The panty of claim 1, further including a transitional area positioned between said crotch section and one of said front and back panels.

13. The panty of claim 12, wherein said transitional area has a knit construction that is different than said front and back panels and said crotch section.

14. A panty comprising front and back panels, front and back transitional areas extending from said front and back panels, and a crotch section positioned between said front and back transitional areas, the panty being constructed of a yarn set that includes a plurality of yarns with one or more of said yarns extending through the front and back panels and transitional areas of the panty, and a pretreated antimicrobial yarn extending through said crotch section and integrated with the one or more yarns that extend through said crotch section.

15. The panty of claim 14, wherein said front and back panels are constructed of a first knit construction and said front and back transitional areas are constructed of a second knit construction.

16. The panty of claim 14, wherein said front panel is constructed of a first construction and said back panel is constructed of a different second construction.

17. The panty of claim 14, wherein said crotch section is constructed of a third knit construction that is different than said first knit construction and said second knit construction.

18. The panty of claim 14, wherein said front and back panels and front and back transitional areas are at least partially constructed of nylon and said crotch section is at least partially constructed of nylon and acetate.

19. The panty of claim 14, wherein said crotch section is effective in controlling moisture.

20. The panty of claim 14, wherein the panty is seamlessly constructed.

21. The panty of claim 1 wherein the crotch section includes a surrounding boundary that defines a crotch area of the panty, and wherein the yarns of the front and back panels transcend the boundary of the crotch section and form a part of the crotch area and wherein the pretreated antimicrobial yarn is confined within the boundary of the crotch section but is integrated with the yarns that form the front and back panel.

22. The panty of claim 21 wherein the pretreated antimicrobial yarn is knitted with the yarn of the front and back panel to form a knitted construction in the crotch area.

23. The panty of claim 1 formed by a continuous knitting process that upon reaching the crotch section is interrupted in order to receive the pretreated antimicrobial yarn that is fed into a knitting machine and integrated into preexisting yarns only in the crotch section of the panty.

24. A method of manufacturing a panty comprising the steps of:

knitting a first panel having a first knit construction using a first yarn type;

seamlessly introducing a second antimicrobial yarn into the panty to form a crotch section integral with the first panty section and having a second knit construction of both the first yarn type and the second antimicrobial yarn wherein said antimicrobial yarn is pretreated with a chlorinated phenoxy antimicrobial; and seamlessly removing said second antimicrobial yarn and knitting a second panel integral with the crotch section having the first knit construction and being knitted from the first yarn type.

25. A panty constructed according to the steps of claim 24.

26. A method of making a panty comprising the steps of:

knitting a tube-like garment having a first section including a first yarn and having a first knit construction;

seamlessly introducing a second yarn with at least said first yarn to knit a second section, said second yarn being an antimicrobial yarn and said second section having a second knit construction different than said first knit construction;

cutting leg openings from a first end of the tube-like garment; and seaming together the first end of the tube-like garment.

27. A panty constructed according to the steps of claim 23.

* * * * *